US007055704B2

(12) United States Patent
Alter

(10) Patent No.: US 7,055,704 B2
(45) Date of Patent: Jun. 6, 2006

(54) LIGHTWEIGHT, STRUCTURALLY INTEGRAL, AND STRONG COMPOSITE RACK SHELVING

(75) Inventor: Rolf M. Alter, Elkwood, VA (US)

(73) Assignee: Composite Concepts, LLC, West Orange, NJ (US)

( * ) Notice: Subject to any disclaimer, the term of this patent is extended or adjusted under 35 U.S.C. 154(b) by 116 days.

(21) Appl. No.: 10/821,753

(22) Filed: Apr. 9, 2004

(65) Prior Publication Data

US 2005/0224435 A1 Oct. 13, 2005

(51) Int. Cl.
*B65D 19/10* (2006.01)
*A47B 5/00* (2006.01)

(52) U.S. Cl. ..... 211/153; 211/90.01; 211/134; 211/183; 211/191; 108/51.11

(58) Field of Classification Search ..... 211/134, 211/135, 186; 160/84.05; 428/593; 52/63, 52/575–77, 783.1, 783.11, 783.13, 783.17, 52/793.1, 651.11, 651.3, 660, 662, 670, 671; 312/408–410, 236; 108/51.3, 57.18, 57.29
See application file for complete search history.

(56) References Cited

U.S. PATENT DOCUMENTS

| | | | | | |
|---|---|---|---|---|---|
| 4,859,517 | A * | 8/1989 | Hull | ..... | 428/116 |
| 5,205,221 | A * | 4/1993 | Melin et al. | ..... | 108/51.3 |
| 5,460,865 | A * | 10/1995 | Tsotsis | ..... | 428/116 |
| 5,543,198 | A * | 8/1996 | Wilson | ..... | 428/116 |
| 5,709,158 | A * | 1/1998 | Wareheim | ..... | 108/186 |
| 5,912,442 | A * | 6/1999 | Nye et al. | ..... | 181/292 |

* cited by examiner

*Primary Examiner*—Richard E. Chilcot, Jr.
*Assistant Examiner*—Jared W. Newton
(74) *Attorney, Agent, or Firm*—Charles E. Baxley

(57) ABSTRACT

Lightweight, structurally integral, and strong composite rack shelving that includes a shelf. The shelf includes a honeycomb core sandwiched between an upper skin and a lower skin so as to form a composite structure that is lightweight and strong. The shelf has a plurality of through bores that pass vertically therethrough which allow flames under the shelf to pass upwardly therethrough instead of sidewardly therealong and to pass an extinguishant thereabove to flow downwardly therethrough for extinguishing the flames thereunder.

4 Claims, 4 Drawing Sheets

LIGHTWEIGHT, STRUCTURALLY INTEGRAL, AND STRONG COMPOSITE RACK SHELVING

BACKGROUND OF THE INVENTION

1. Field of the Invention

The present invention relates to rack shelving. More particularly, it relates to lightweight, structurally integral, strong composite rack shelving.

2. Description of the Prior Art

Numerous innovations for rack shelving have been provided in the prior art. Even though they frequently are suitable for specific purposes which they address, they each differ in structure and/or operation and/or purpose from the present invention and they therefore are not suitable for the purposes of the present invention.

A typical prior art rack system 20 can be seen in FIGS. 1 and 2, which are, respectively, a diagrammatic perspective view of a typical prior art rack system illustrating columns, beams, and a shelf thereof in use, and an enlarged diagrammatic top plan view of the area generally enclosed by a dotted curve identified by ARROW 2 in FIG. 1 illustrating a spacer utilized for the shelf shown in FIG. 1, and as such, will be discussed with reference thereto.

The typical prior art rack system 20 comprises columns 22, beams 24, and a shelf 26. The columns 22 are vertical support members which interconnect with the beams 24 which are horizontal support members. Each column 22 has rows of slots 28 which are vertically extending and each beam 24 has pins 30 which are spaced apart from each other and which insert into the slots 28 in the column 22. Each beam 24 further has a step 32 extending therealong which has the shelf 26 rest thereon.

The beam 24 is connected to the column 22 by first inserting the pins 30 of the beam 24 into upper portions 34 of the slots 28 in the column 22 and then sliding the pins 30 of the beam 24 downwardly into lower portions 36 of the slots 28 in the column 22. When the beam 24 is so connected, a portion of the pin 30 of the beam 24 projects beyond an associated slot 28 in the column 22 to secure the beam 24 from axially disengaging from the column 22, i.e., the beam 24 can only be disconnected by reversing the connection sequence.

Once the beam 24 is connected to the column 22 by inserting the pins 30 of the beam 24 into the upper portions 34 of the slots 28 in the column 22 and sliding them downwardly into the lower portions 36 of the slots 28 in the column 22, the beam 24 will remain secured to the column 22 so long as there is a downward force on the pins 30 of the beam 24.

The shelf 26 comprises a plurality of boards 38, which are free from each other, and which are wood. Each board 38 of the shelf 26 extends transversely, and has a pair of ends 40 which rest on the steps 32 of the beams 24, respectively. The plurality of boards 38 of the shelf 26 are spaced-apart from each other by spacers 42.

Each spacer 42 is bent from a strip of metal into a body 44 and a pair of wings 46. The body 44 of the spacer 42 generally is U-shaped and has terminal ends 48 from which the pair of wings 46 of the spacer 42 extend perpendicularly outwardly.

The spacer 42 rests on the step 32 of the beam 24 with the body 44 of the spacer 42 spacing apart a pair of adjacent boards 38 of the shelf 26. The spacer 42 is maintained on the step 32 of the beam 24 only by the pair of wings 46 of the spacer 42 being sandwiched between adjacent ends 40 of the pair of adjacent boards 38 of the shelf 26 and the beam 24. Each board 38 therefore must have a specific width, i.e., a width extending from the body 44 of one spacer 42 to the body 44 of an adjacent spacer 44.

Thus, the shelf 26 comprises a plurality of separate, non-mechanically connected parts, namely, the plurality of boards 38 and the spacers 42, and as a result thereof, afford little structural integrity for the shelf 26. Further, the shelf 26 is heavy as a result of the plurality of boards 38 being wood.

Thus, there exists a need for composite rack shelving which affords structural integrity by having no non-mechanically connected parts, is light weight and strong, and allows flames thereunder to pass upwardly therethrough instead of sidewardly therealong and an extinguishant thereabove to pass downwardly therethrough and extinguish the flames thereunder.

SUMMARY OF THE INVENTION

ACCORDINGLY, AN OBJECT of the present invention is to provide lightweight, structurally integral, and strong composite rack shelving that avoids disadvantages of the prior art.

ANOTHER OBJECT of the present invention is to provide lightweight, structurally integral, and strong composite rack shelving that is simple to use.

BRIEFLY STATED, STILL ANOTHER OBJECT of the present invention is to provide lightweight, structurally integral, and strong composite rack shelving that includes a shelf. The shelf comprises a honeycomb core sandwiched between an upper skin and a lower skin so as to form a composite structure that is lightweight and strong. The shelf has a plurality of through bores that pass vertically therethrough and allow flames under the shelf to pass upwardly therethrough instead of sidewardly therealong and allow an extinguishant thereabove to pass downwardly therethrough to extinguish flames thereunder.

Novel features which are considered characteristic of the present invention are identified in the appended claims. The invention itself, however, both as to its construction and its method of operation, together with additional objects and advantages thereof, will be best understood a description of the invention which follows, read in connection with the accompanying drawings.

BRIEF DESCRIPTION OF THE DRAWINGS

The figures of the drawings are briefly described as follows.

LIST OF REFERENCE NUMERALS UTILIZED IN THE DRAWINGS

Prior Art

Figures 1, 2:
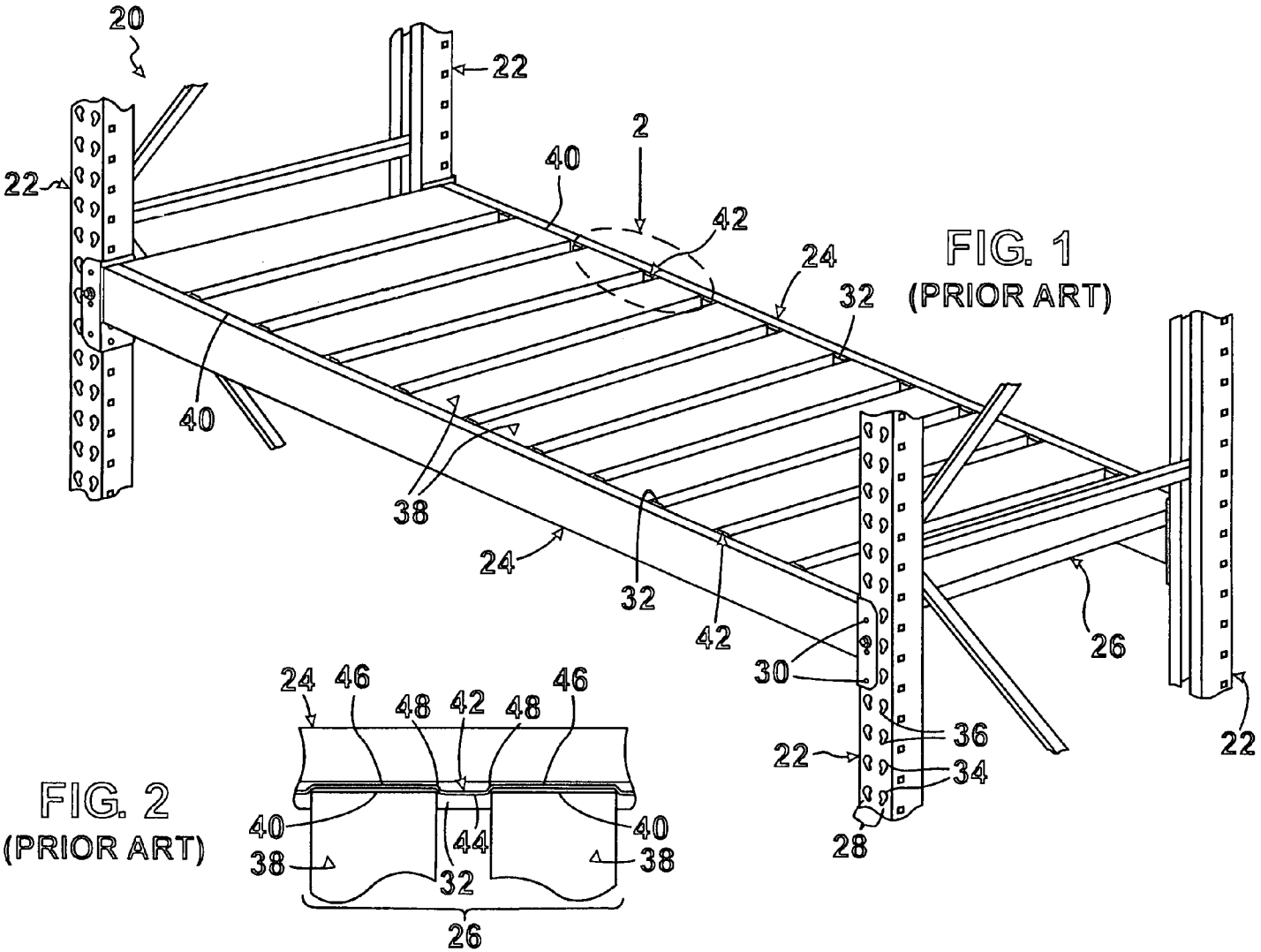
FIG. 1 (PRIOR ART)
FIG. 2 (PRIOR ART)
FIG. 1 is a diagrammatic perspective view of a typical prior art rack system illustrating columns, beams, and a shelf thereof in use.
FIG. 2 is an enlarged diagrammatic top plan view of the area generally enclosed by the dotted curve identified by ARROW 2 in FIG. 1 illustrating a spacer utilized for the shelf shown in FIG. 1.

20 typical prior art rack system
22 columns
24 beams
26 shelf
28 slots in each of the columns 22
30 pins in each of the beams 24
32 step of each of the beams 24
34 upper portions of slots 28 in each of the 36 columns 22
36 lower portions of slots 28 in each of the columns 22
38 plurality of boards of shelf 26
40 pair of ends of each of the boards 38 of the shelf 26
42 spacers
44 body of each of the spacers 42
46 pair of wings of each of the spacers 42
48 terminal ends of body 44 of each of the spacers 42

Present Invention

50 lightweight, structurally integral, and strong composite rack shelving of present invention
52 flames
54 extinguishant
56 shelf
58 plurality of through bores through shelf 56 for allowing flames 52 thereunder to pass upwardly therethrough instead of sidewardly therealong and extinguishant 54 thereabove to pass downwardly therethrough and extinguish flames 52 thereunder.
60 honeycomb core of shelf 56
62 upper skin of shelf 56
64 lower skin of shelf 56
66 composite structure of shelf 56
68 walls of honeycomb core 60 of shelf 56
70 cells of honeycomb core 60 of shelf 56
72 periphery of shelf 56
74 border
80 inserts

DETAILED DESCRIPTION OF THE INVENTION

Figure 3:
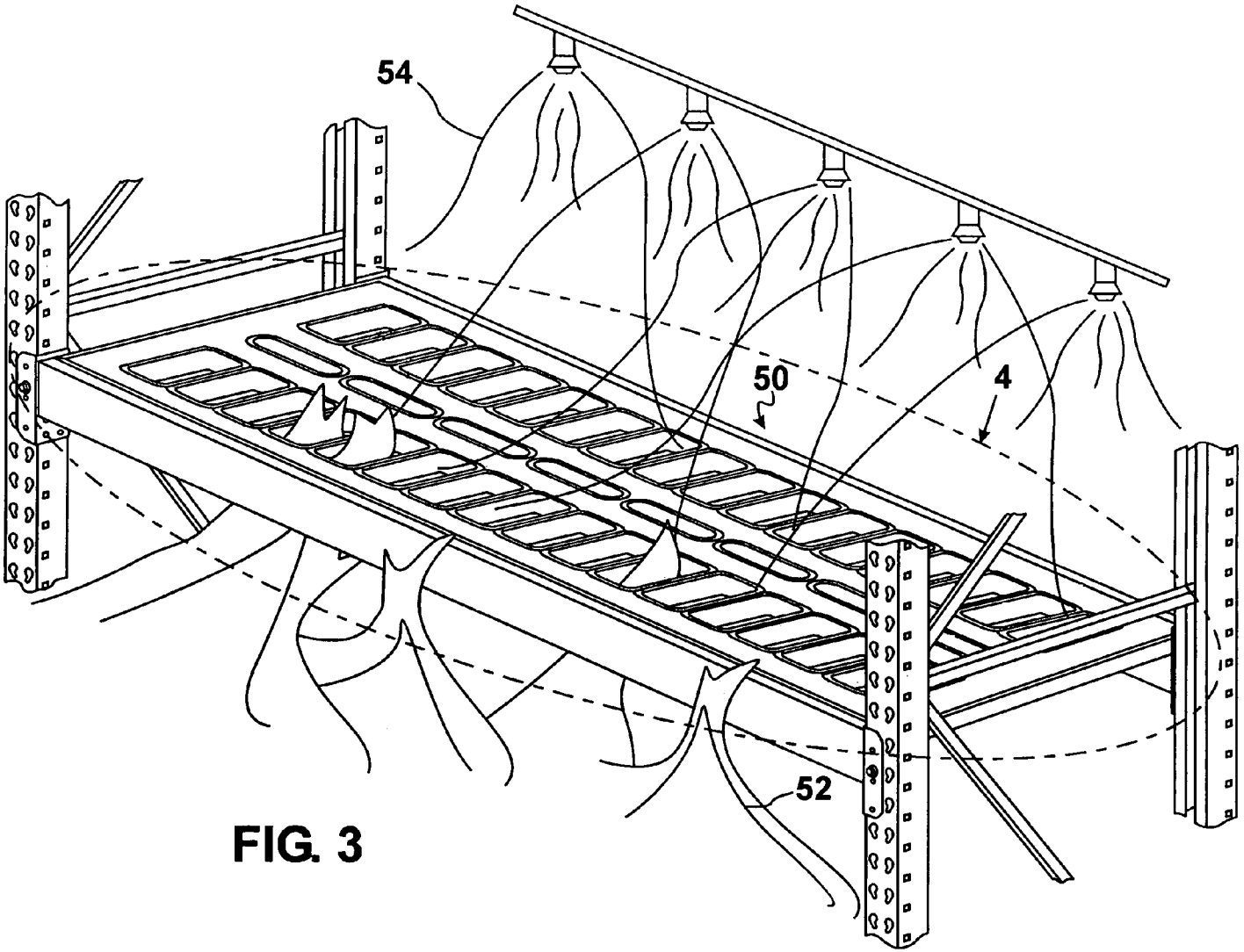
FIG. 3 is a diagrammatic perspective view of a rack system illustrating the prior art columns, the prior art beams, and the composite shelf of the present invention in use, with the composite shelf being lightweight, structurally integral, and strong.

Referring now to the figures, in which like numerals indicate like parts, and particularly to FIG. 3, which is a diagrammatic perspective view of a rack system illustrating prior art columns, prior art beams, and a composite shelf of the present invention in use, with the composite shelf being lightweight, structurally integral, and strong, the composite rack shelving of the present invention is shown generally at 50.

Figure 4:
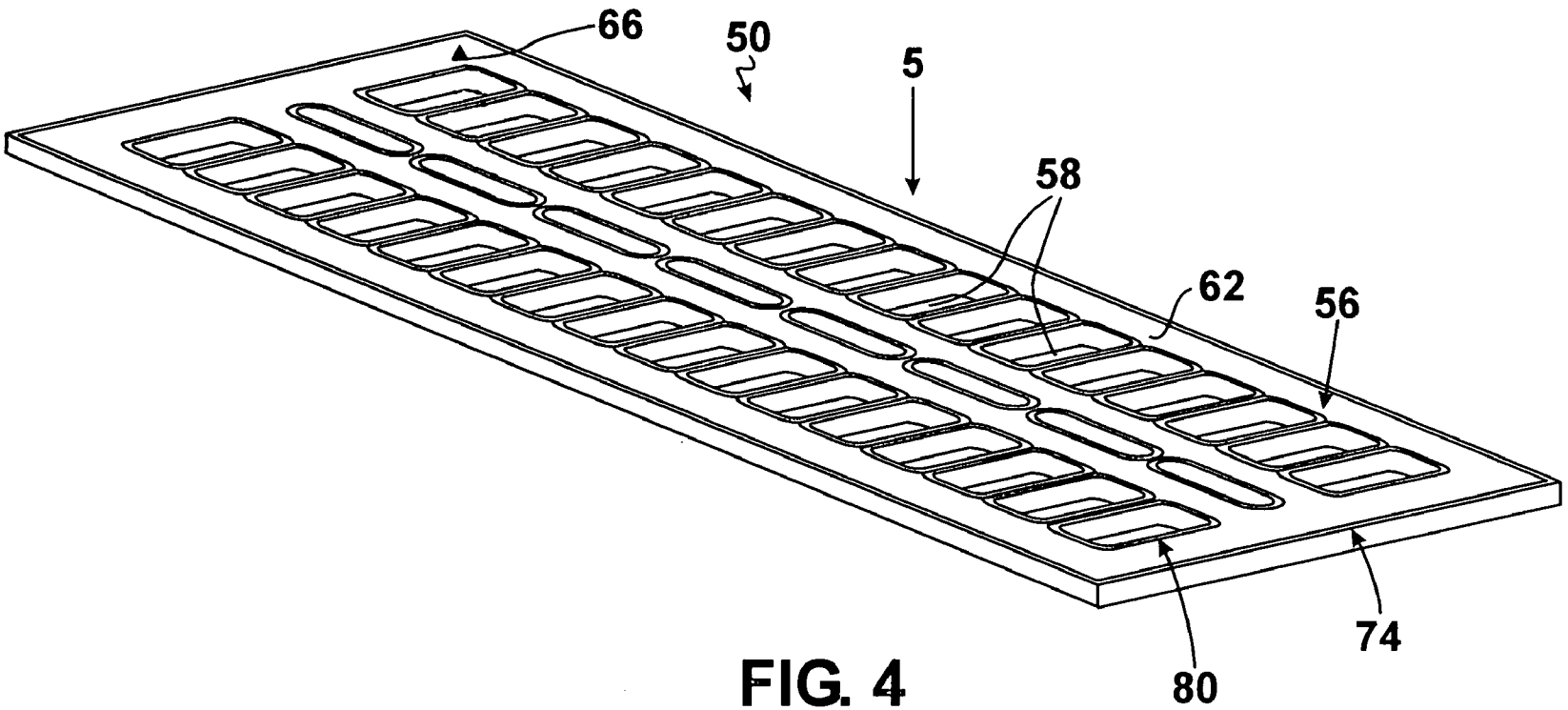
FIG. 4 is an enlarged diagrammatic perspective view of the area generally enclosed by the dotted curve identified by ARROW 4 in FIG. 3 illustrating the lightweight, structurally integral, and strong composite rack shelving of the present invention shown in FIG. 3.
Figure 5:
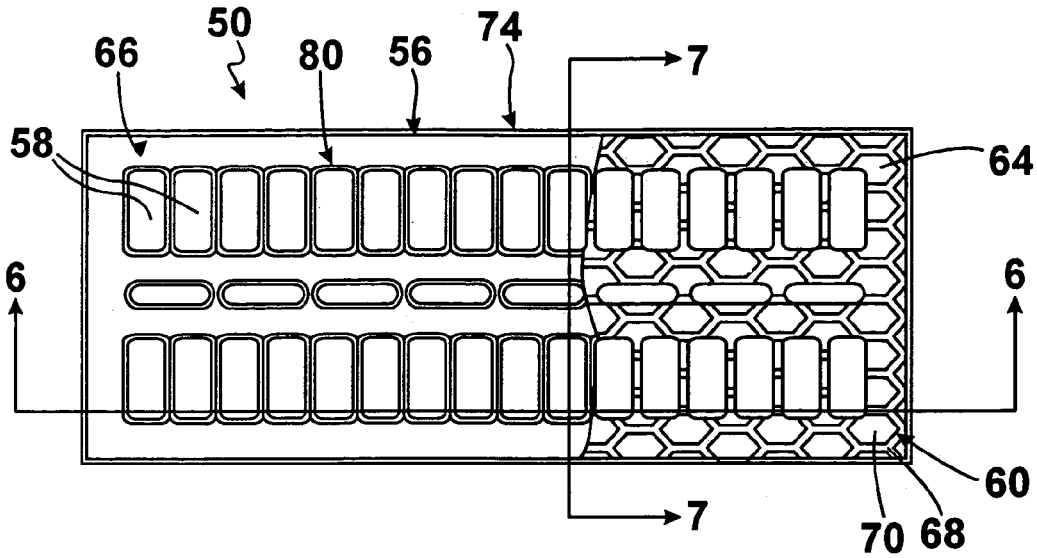
FIG. 5 is a diagrammatic top plan view taken generally in the direction of ARROW 5 in FIG. 4 illustrating the lightweight, structurally integral, and strong composite rack shelving of the present invention shown in FIG. 4 with a portion of the upper skin thereof removed to reveal a portion of the honeycomb core thereof at an enlarged scale.
Figure 6:
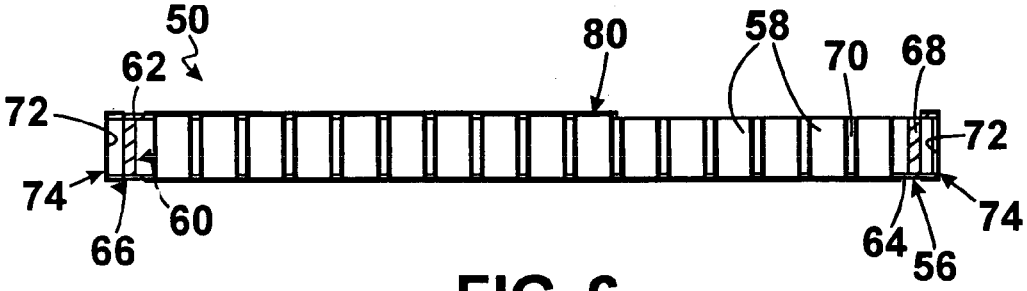
FIG. 6 is a diagrammatic cross sectional view taken along line 6—6 in FIG. 5.
Figure 7:
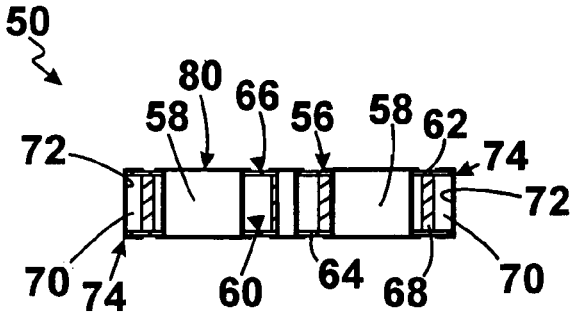
FIG. 7 is a diagrammatic cross sectional view taken along line 7—7 in FIG. 5.

The configuration of the composite rack shelving 50 can best be seen in FIGS. 3–7, which are, respectively, again a diagrammatic perspective view of a rack system illustrating the prior art columns, the prior art beams, and the composite shelf of the present invention in use, with the composite shelf being lightweight, structurally integral, and strong, an enlarged diagrammatic perspective view of the area generally enclosed by the dotted curve identified by ARROW 4 in FIG. 3 illustrating the composite rack shelving of the present invention shown in FIG. 3, a diagrammatic top plan view taken generally in the direction of ARROW 5 in FIG. 4 illustrating the composite rack shelving of the present invention shown in FIG. 4 with a portion of the upper skin thereof removed to reveal a portion of the honeycomb core thereof, a diagrammatic cross sectional view taken along line 6—6 in FIG. 5, and a diagrammatic cross sectional view taken along line 7—7 in FIG. 5, and as such, will be discussed with reference thereto.

The composite rack shelving 50 comprises a shelf 56. The shelf 56 comprises a honeycomb core 60, an upper skin 62, and a lower skin 64. The honeycomb core 60 of the shelf 56 is sandwiched between the upper skin 62 of the shelf 56 and the lower skin 64 of the shelf 56 so as to form a composite structure 66 that is lightweight and strong.

The shelf 56 has a plurality of through bores 58 that pass vertically therethrough. The plurality of through bores 58 through the shelf 56 are for allowing flames 52 thereunder to pass upwardly therethrough instead of sidewardly therealong and an extinguishant 54 thereabove to pass downwardly therethrough and extinguish the flames 52 thereunder.

The shelf 56 has a surface area, and the plurality of through bores 58 through the shelf 56 occupy 50% of the surface area of the shelf 56.

The honeycomb core 60 of the shelf 56 comprises walls 68 that define cells 70.

The shelf 56 further has a periphery 72, and the composite rack shelving 50 further comprises a border 74. The border 74 closes off the periphery 72 of the shelf 56, and is a tape that is affixed to any wall 68 of the honeycomb core 60 of the shelf 56 that it comes in contact with, especially any that defines an open cell 70 of the honeycomb core 60 of the shelf 56 located at the periphery 72 of the shelf 56 so as to maintain structural integrity of the shelf 56 by closing off any open cell 70 of the honeycomb core 60 of the shelf 56 located at the periphery 72 of the shelf 56 and form a structurally integral unit with the shelf, and which folds over to be affixed to the upper skin 62 of the shelf 56 and the lower skin 64 of the shelf 56.

The composite rack shelving 50 further comprises inserts 80. The inserts 80 line the plurality of through bores 58 through the shelf 56, respectively, and are tapes that are affixed to any wall 68 of the honeycomb core 60 of the shelf 56 that they come in contact with, especially any that defines an open cell 70 of the honeycomb core 60 of the shelf 56 caused by a through bore 58 through the shelf 56 so as to maintain structural integrity of the shelf 56 by closing off any open cell 70 of the honeycomb core 60 of the shelf 56 caused by a through bore 58 through the shelf 56 and form a structurally integral unit with the shelf 56, and which fold over to be affixed to the upper skin 62 of the shelf 56 and the lower skin 64 of the shelf 56.

Although the invention has been illustrated and described as embodied in a lightweight, structurally integral, and strong composite rack shelving, it is not limited to the details shown, since it will be understood that various omissions, modifications, substitutions, and changes in the forms and details of the device illustrated and its operation can be made by those skilled in the art without departing from the spirit of the present invention.

Without further analysis the foregoing will so fully reveal the gist of the present invention that others can by applying current knowledge readily adapt it for various applications without omitting features that from the standpoint of prior art fairly constitute characteristics of the generic or specific aspects of the present invention.

The invention claimed is:

1. Lightweight, structurally integral, and strong composite rack shelving, comprising:

a) shelf;

b) a border; and c) inserts;

wherein said shelf comprises a honeycomb core;

wherein said shelf comprises an upper skin;

wherein said shelf comprises a lower skin;

wherein said honeycomb core of said shelf is sandwiched between said upper skin of said shelf and said lower skin of said shelf so as to form a composite structure;

wherein said composite structure of said shelf is lightweight;

wherein said composite structure of said shelf is strong;

wherein said shelf has a plurality of through bores;

wherein said plurality of through bores pass vertically through said shelf;

wherein said plurality of through bores through said shelf allow flames under said shelf to pass upwardly therethrough instead of sidewardly therealong whereby an extinguishant thereabove can pass downwardly therethrough for extinguishing flames thereunder;

wherein said shelf has a periphery;

wherein said border closes off said periphery of said shelf;

wherein said honeycomb core of said shelf comprises walls;

wherein said walls of said honeycomb core of said shelf define cells;

wherein said border is a tape;

wherein said tape of said border is affixed to any wall of said honeycomb core of said shelf that it comes in contact with, and any wall defining an open cell of said honeycomb core of said shelf located at said periphery of said shelf so as to maintain structural integrity of said shelf by closing off any open cell of said honeycomb core of said shelf located at said periphery of said shelf and form a structurally integral unit with said shelf, and which folds over to be affixed to said upper skin of said shelf and said lower skin of said shelf;

wherein said inserts line said plurality of through bores through said shelf, respectively;

wherein said inserts are tapes;

wherein said tapes of said inserts are affixed to any wall of said honeycomb core of said shelf that they come in contact with, and any wall defining an open cell of said honeycomb core of said shelf caused by a through bore through said shelf so as to maintain structural integrity of said shelf by closing off any open cell of said honeycomb core of said shelf caused by a through bore through said shelf and form a structurally integral unit with said shelf, and which fold over to be affixed to said upper skin of said shelf and said lower skin of said shelf.

2. The shelving as defined in claim 1, wherein said shelf has a surface area; and wherein said plurality of through bores through said shelf occupy approximately 50% of said surface area of said shelf.

3. An improved rack system of the type having columns, beams interconnected to the columns, and shelving supported by the beams, said improvement comprising:

a) the shelving being lightweight;

b) the shelving being structurally integral;

c) the shelving being strong;

d) the shelving comprising a shelf;

e) said shelf comprising a honeycomb core;

f) said shelf comprising an upper skin;

g) said shelf comprising a lower skin;

h) said honeycomb core of said shelf being sandwiched between said upper skin of said shelf and said lower skin of said shelf so as to form a composite structure;

i) said composite structure of said shelf being lightweight;

j) said composite structure of said shelf being strong;

k) said shelf having a plurality of through bores;

l) said plurality of through bores passing vertically through said shelf;

m) said plurality of through bores through said shelf being for allowing flames under said shelf to pass upwardly therethrough instead of sidewardly therealong and an extinguishant thereabove to pass downwardly therethrough and extinguish the flames thereunder;

n) said shelf having a periphery;

o) the shelving comprising a border;

p) said border closing off said periphery of said shelf;

q) said honeycomb core of said shelf comprising walls;

r) said walls of said honeycomb core of said shelf defining cells;

s) said border being a tape;

t) said tape of said border being affixed to any wall of said honeycomb core of said shelf that it comes in contact with, and any wall defining an open cell of said honeycomb core of said shelf located at the periphery of said shelf so as to maintain structural integrity of said shelf by closing off any open cell of said honeycomb core of said shelf located at the periphery of said shelf and form a structurally integral unit with said shelf, and which is folded over to be affixed to said upper skin of said shelf and said lower skin of said shelf;

u) the shelving comprising inserts;

v) said inserts lining said plurality of through bores through said shelf, respectively;

w) said inserts being tapes; and x) said tapes of said inserts being affixed to any wall of said honeycomb core of said shelf that they come in contact with, and any wall defining an open cell of said honeycomb core of said shelf caused by a through bore through said shelf so as to maintain structural integrity of said shelf by closing off any open cell of said honeycomb core of said shelf caused by a through bore through said shelf and form a structurally integral unit with said shelf, and which are folded over to be affixed to said upper skin of said shelf and said lower skin of said shelf.

4. The improved rack system as defined in claim 3, wherein said shelf has a surface area; and wherein said improvement comprises said plurality of through bores through said shelf occupying 50% of said surface area of said shelf.

* * * * *